US010954638B2

(12) United States Patent
Brown

(10) Patent No.: US 10,954,638 B2
(45) Date of Patent: Mar. 23, 2021

(54) FLOW BOULEVARD; CONTINUOUS FLOWING TRAFFIC ON INTERRUPTED URBAN STREETS

(71) Applicant: Phillip Jon Brown, Beverly Hills, CA (US)

(72) Inventor: Phillip Jon Brown, Beverly Hills, CA (US)

( * ) Notice: Subject to any disclaimer, the term of this patent is extended or adjusted under 35 U.S.C. 154(b) by 0 days.

(21) Appl. No.: 14/028,411

(22) Filed: Sep. 16, 2013

(65) Prior Publication Data

US 2015/0078820 A1 Mar. 19, 2015

(51) Int. Cl.

| | |
|---|---|
| ***E01C 1/00*** | (2006.01) |
| ***G08G 1/07*** | (2006.01) |
| ***E01C 1/02*** | (2006.01) |
| ***G08G 1/08*** | (2006.01) |
| ***G08G 1/081*** | (2006.01) |

(52) U.S. Cl.

CPC ..... *E01C 1/002* (2013.01); *E01C 1/02* (2013.01); *G08G 1/07* (2013.01); *G08G 1/081* (2013.01)

(58) Field of Classification Search

CPC .. E01C 1/02; E01C 1/04; E01C 1/002; G08G 1/07

See application file for complete search history.

(56) References Cited

U.S. PATENT DOCUMENTS 2,926,333 A * 2/1960 Masten ..... 340/913
3,883,842 A * 5/1975 Marmo ..... G08G 1/07 340/932
5,278,554 A * 1/1994 Marton ..... G08G 1/081 340/909
5,330,278 A * 7/1994 Raswant ..... 404/1
5,673,039 A * 9/1997 Pietzsch ..... G08G 1/015 340/332
5,821,878 A * 10/1998 Raswant ..... 340/907
5,959,553 A * 9/1999 Raswant ..... 340/907
6,708,085 B2 * 3/2004 Yamane et al. ..... 701/1
7,663,505 B2 * 2/2010 Publicover ..... 340/932
7,755,510 B2 * 7/2010 Bilimoria ..... G08G 1/22 340/932
7,860,639 B2 * 12/2010 Yang ..... 701/117
8,050,854 B1 * 11/2011 Chandra et al. ..... 701/117
8,136,969 B2 * 3/2012 Burkett ..... H05B 47/16 362/459
2009/0322561 A1 * 12/2009 Morioka et al. ..... 340/907
2011/0181440 A1 * 7/2011 Bunz et al. ..... 340/907
2012/0161982 A1 * 6/2012 Musachio ..... G08G 1/08 340/932
2012/0326890 A1 * 12/2012 Cross ..... 340/906

* cited by examiner

*Primary Examiner* — Abigail A Risic
(74) *Attorney, Agent, or Firm* — Omni Legal Group; Ariana Samtoro; Omid E. Khalifel

(57) ABSTRACT

A Flow Boulevard system of transportation for existing urban and suburban streets which optimizes vehicular capacity and flow for at grade facilities having intervening crossing streets is provided. The system may be applied to a single street right of way having two-way traffic with a median and enables packs of traffic to continuously flow in both directions concurrently. Flow Boulevards may be connected through interchanges supporting continuously flowing traffic to that connect to couplets of one-way streets to define networks of high vehicular capacity and continuous flowing traffic over large urban areas. Lane signals are provided to optimize traffic flow in each flow boulevard lane and at each interchange.

10 Claims, 8 Drawing Sheets

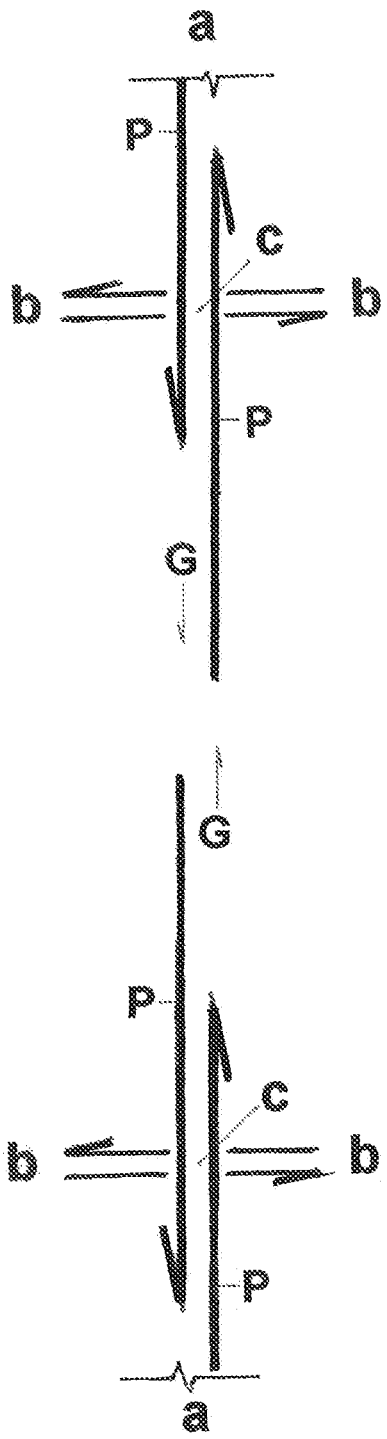
Figure 2X
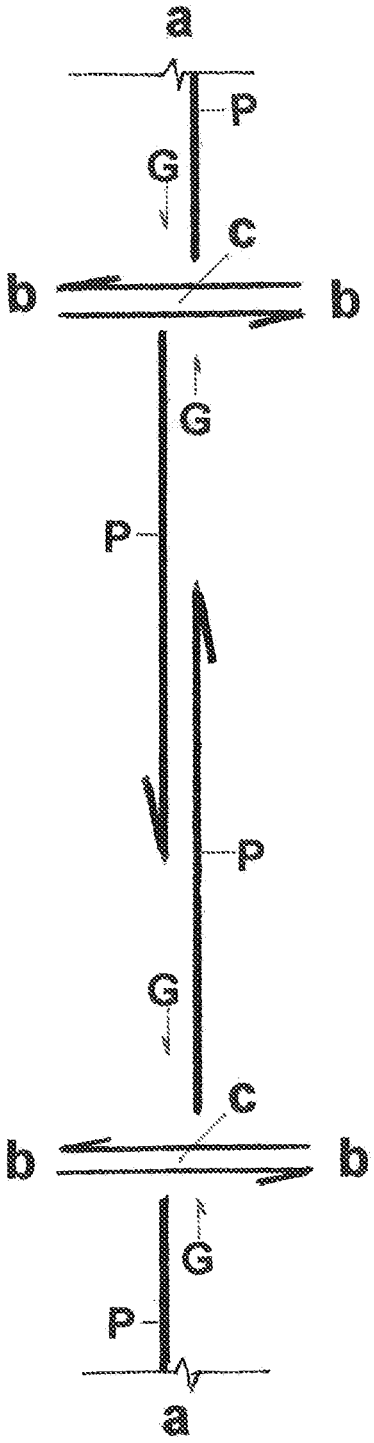
Figure 2Y
Figure 2

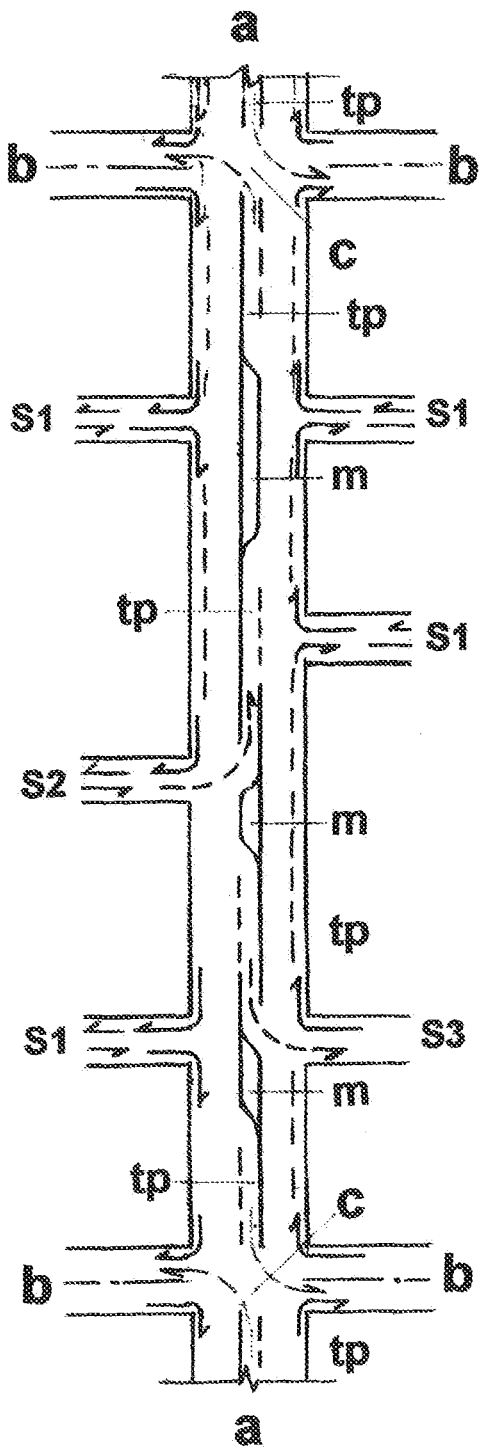
Figure 3X
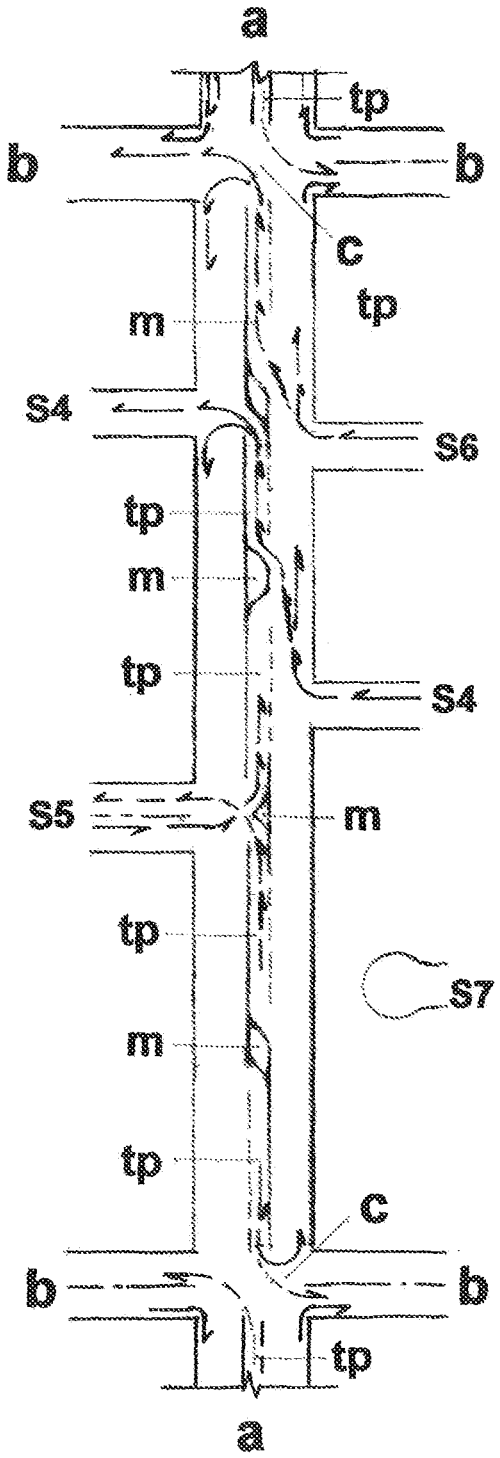
Figure 3Y
Figure 3

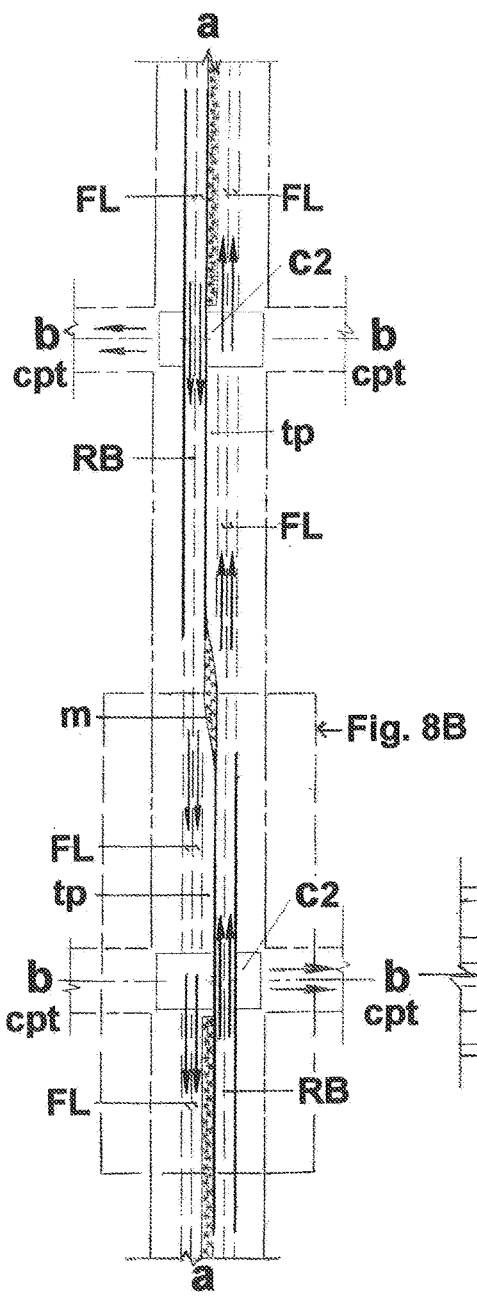
Figure 8A
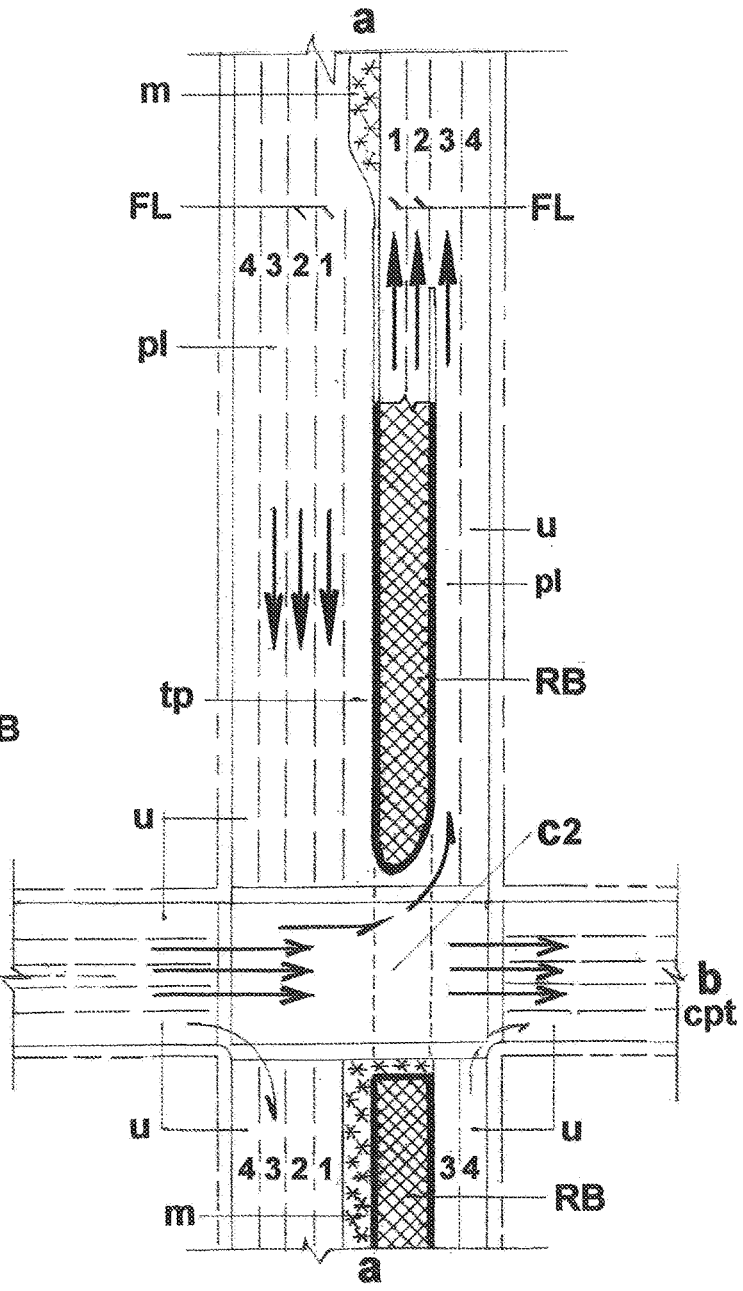
Figure 8B
Figure 8

FLOW BOULEVARD; CONTINUOUS FLOWING TRAFFIC ON INTERRUPTED URBAN STREETS

CROSS-REFERENCE TO RELATED APPLICATIONS

The Flow Boulevard innovation has continuous flowing traffic on a two-way traffic urban street and has intersections at grade for crossing traffic. There is not a specific traffic control system specified for the roadway system in that there could be various types of traffic control and that the innovation is not about methods of control. Many of the patents cited below are related but unlike the Flow Boulevard in that they have grade separated intersections or use one-way streets, usually in a grid of one-way streets. There is one patent without grade separated intersections and has a two-way traffic roadway, but it has a rural context without much cross traffic and is a very different design.

U.S. Patent Documents

Masten U.S. Pat. No. 2,926,333 340/40
Raswant U.S. Pat. No. 5,092,705 404/1
Raswant U.S. Pat. No. 4,927,288 40 4/1
Barel U.S. Pat. No. 5,897,270 404/1
Okubo U.S. Pat. No. 3,238,854 40 4/1
Hara U.S. Pat. No. 3,386,351 404/1
Burrell U.S. Pat. No. 3,394,638 40 4/1
Heller U.S. Pat. No. 5,795,095 404/1
Sutchiewcharn U.S. Pat. No. 8,366,342 404/1

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENTS REGARDING PRIOR DISCLOSURES BY THE INVENTOR OR A JOINT INVENTOR

No disclosures have been made.
Not Applicable

BACKGROUND OF THE INVENTION

The particular area of invention that the Flow Boulevard would be classified in by the USPTO would be 404/1, roadways. A more common reference that is used by the Transportation Research Board (US) in the Highway Capacity Manual would be that the Flow Boulevard is an Interrupted Flow Facility. Interrupted flow facilities are urban arterials with intersections and the like. Interrupted flow facilities are to be differentiated from "uninterrupted" flow facilities such as freeways and with rural highways that have very few intersections and little traffic.

The specific street used as the Flow Boulevard is a single street right of way having two way traffic and would best be described as an interrupted flow facility because it is urban in use and has interrupting intersections for crossing arterial traffic at grade and has heavy traffic in the FB alignment. What the Flow Boulevard (FB) endeavors to do is to minimize the retarding effects to traffic flow by omitting interruptions which lower the average speed through the FB corridor and the vehicular capacity of the facility as well. This increase in capacity and a reduced time through a corridor is achieved by arranging the street elements so that where crossing traffic at intersections are reduced to just an essential number, and which this also allows long groups of traffic to develop in traffic flows between those intersections. The spacing of such signalized intersections are timed with the speed of the opposing vehicular groups so that they pass through the intersections simultaneously to allow continuously flowing of traffic in both directions through the FB corridor without stopping.

This approach to raising the capacity of lanes, as opposed to adding lanes to gain more capacity, often means much less impacts to existing corridors which may otherwise require various expansions like the dedication for extra street width for a street right of way, or the taking of parking lanes, or reducing sidewalk widths and the like. Stop and go traffic can have an unwanted character by allowing increased speeds for more capacity, which can be an impact to street faced businesses and is less safe generally for all concerned. Further the introduction of grade separated intersections for cross traffic can be both a physical impact to existing development, a costly construction addition to a budget, as well as being difficult for traffic operationally in limited urban spaces.

A FB related way of gaining flowing traffic on urban streets is with one-way couplets where each separate street has its own progressive signalization. However there is many an urban street pattern where two such streets are not easily brought together so that operation can be made. Such is the case so that continuous flowing traffic in a single street right of way can be a way to link up flowing corridors especially when the single street corridor FB has a method of providing interchanges which are able to flow continuously and connect with other street patterns including couplets. Therefore the innovation that this application consists of is for the single street FB and its connecting interchanges but not the street patterns beyond such interchanges.

Street grid patterns and grade separated intersections are not what the FB is about. The character of a FB serves that of a lineal corridor that needs high capacity for large volume travel demand. These situations develop when various medium density development patterns merge together over time and the travel demand out grows the original street patterns making bottlenecks and segments of corridors that just can't provide the needed capacity by the generally disorderly inefficient result of previous developed street patterns. Short distances between signals on a two-way street are often the weak links in a corridor. Under high volumes of traffic short distances between intersections load up with traffic that does not clear on the signal cycle so that a gridlock like bottleneck develops and the intersection can fail taking the average speed down to low single digits which can then back up traffic in the corridor behind it for great distances. This is where to see if a FB can provide the answer of providing the additional capacity that is both low in cost improvement and low in impact by essentially being of the same kind of vehicular serving system that exists but with the needed extra capacity that can move traffic.

RELATED AND UNRELATED ART

The FB is simply a nuanced improvement of making a new orderly organization of those typical types of vehicular transportation elements which then allows continuous flowing traffic in both directions. To be specific the problem of making continuous flow traffic in an urban single street right of way with two-way traffic has not appeared to be a problem to have been solved by others. There are several patents that deal with grid street patterns using progressive signalization such as, John K Masten's U.S. Pat. No. 2,926,333 and Raswant's U.S. Pat. No. 5,092,705, but the Flow Boulevard is a single street right of way and does not use progressive signalization, nor is the FB comprised of a grid of one-way traffic streets. There are numerous patents that are for grade separated highway intersections including freeway type facilities but the FB does not use grade separated intersections as an approach to provide flowing traffic as part of its core innovation.

A patent that is to be used in corridors and thereby is somewhat related to the FB is the Meir Barrel U.S. Pat. No. 5,897,270 entitled Vehicle Highway System Having Single-Level Uninterrupted Traffic-Flow Intersection. It also has a barrier between the two way traffic to avoid cross-traffic interruptions. But the character of the system lends itself to more of a rural condition and it implies low cross traffic volume demand. The traffic return design element that would be used instead of an intersection for cross traffic would take extra space in a truly urban location and cross traffic volumes appears to just not be adequate by urban standards.

And then there is the matter of forming and controlling packs of vehicles in flowing traffic. Any number of these traffic control systems might have application for use on a FB but any particular signal traffic control system for the formation of vehicular packs of vehicles are not essential to the FB roadway basic architecture. It is acknowledged that a separate patentable system can be used and that in certain instances it may be essential to get the performance that is sought; but this is for that particular project to deal with and incorporate. There is also natural self-organizing driving behavior which seeks to be efficient that may take advantage of driving techniques to make the best of the FB operation simply by instruction or self-instruction that gives adequate performance given the travel demand involved. So that would come under the heading of a "non-system" of traffic control. But I realize that to get the most out of the FB roadway architecture given growing demand may also require several such traffic systems that would follow one another with ever greater apparatus and technology over time. So it is not for me to specify a travel demand condition and a specific vehicular pack forming method.

BRIEF SUMMARY OF THE INVENTION

Making traffic flow with high capacity, which is a main objective of the innovation, is a matter of organizing it so it can do so. And higher capacity is the ingredient needed to fix the congested street that is failing in the peak traffic periods. Failing urban boulevard traffic can generally reduce the street capacity by about half when traffic is approaching the 5 mph speed of traffic moving through the corridor. This means that during a normal capacity for stop and go driving conditions on a regular "unorganized" urban street there are about 600 vehicles per hour per lane in operation at an average through travel of 30 mph. When the traffic condition becomes so congested with failing intersections, and the average speed is 5 mph through the corridor, there are about 300 vehicles per hour per lane. The street has lost half of its capacity and the street is on the verge of gridlock.

To fix the "unorganized" urban street so it does not fail is to organize it so there are not going to be failing intersections and other interruptions to flowing traffic by organizing it with the Flow Boulevard (FB) relationships. A well designed Flow Boulevard still with an average speed of 30 mph through the corridor can have 1100 or more vehicles per hour per lane flowing through the corridor. This almost doubles the capacity of the corridor over that normal "unorganized" stop and go operation which means that the boulevard is not going to fail during the congestion of the usual commuting periods of the day.

The key to the optimization of flowing vehicles is made by forming closely spaced vehicles into a long pack and by having a gap between such packs which serves as an opportunity for cross traffic to cross the FB at the timed intersections. As an example, if the FB intersections are on a one mile separation and there is one vehicle pack and one gap per mile and are traveling at 30 mph; with the intersection signals set with a two minute cycle having 72 seconds for the FB green period traffic use, and 48 seconds for the cross street traffic period (72 sec plus the 48 sec equals the two minute signal cycle) which would include all the turning movements involved at the intersection as well, that can give a capacity of about a vehicle each 2 seconds on average giving that 1100 vehicles per hour per lane. That would essentially eliminate the peak period traffic failure. Actually the 1100 vehicle/hour/lane capacity would give room for growth of travel in the corridor or for much more time and space between vehicles with a higher level of service.

This kind of traffic operation can fix many such corridors in the urban context where there has been land use development that now exceeds the capacity of the original street pattern. This is a relatively low cost and low impact way to make the relationship between land use and transportation much more livable and functional. To try to add light rail to gain capacity could be much more costly, have many physical and operational impacts and not be compatible with the existing form of transportation. All of the elements that comprise the Flow Boulevard need to be designed, timed, engineered and have the appropriate capacity to serve and solve for the given context and travel demand in that corridor. And the key to it being economical is that it can generally be done within the existing right of way of existing streets with no street widening.

Flowing vehicular traffic using fossil fuels as opposed to stop and go congested traffic produces much less greenhouse gas emissions than stop and go congested traffic. And by using strategically planned denser land use development supported by Flow Boulevards the proximity of community attractions and services can reduce vehicular miles traveled generally. So the FB has great planning benefits as well.

Flow Boulevard corridor development would likely occur in two different kinds of urban areas. The first is a medium density urban area where congestion has already developed and there needs to be a way to eliminate congestion so the commerce and the maintaining of an attractive quality of life can be made. The other area of development would be a lower density suburban area that is growing with medium density corridors as a way to improve its livability, efficiency and with proximity to community functions to reduce vehicular miles traveled and reduce GHG emissions.

And of course, with the FB interchanges that can link the high capacity FB corridor with other existing street patterns there then becomes a basis that large networks can be developed in the existing city context to fulfill transportation needs and solve congestion problems over large areas of a city.

Figure 1:
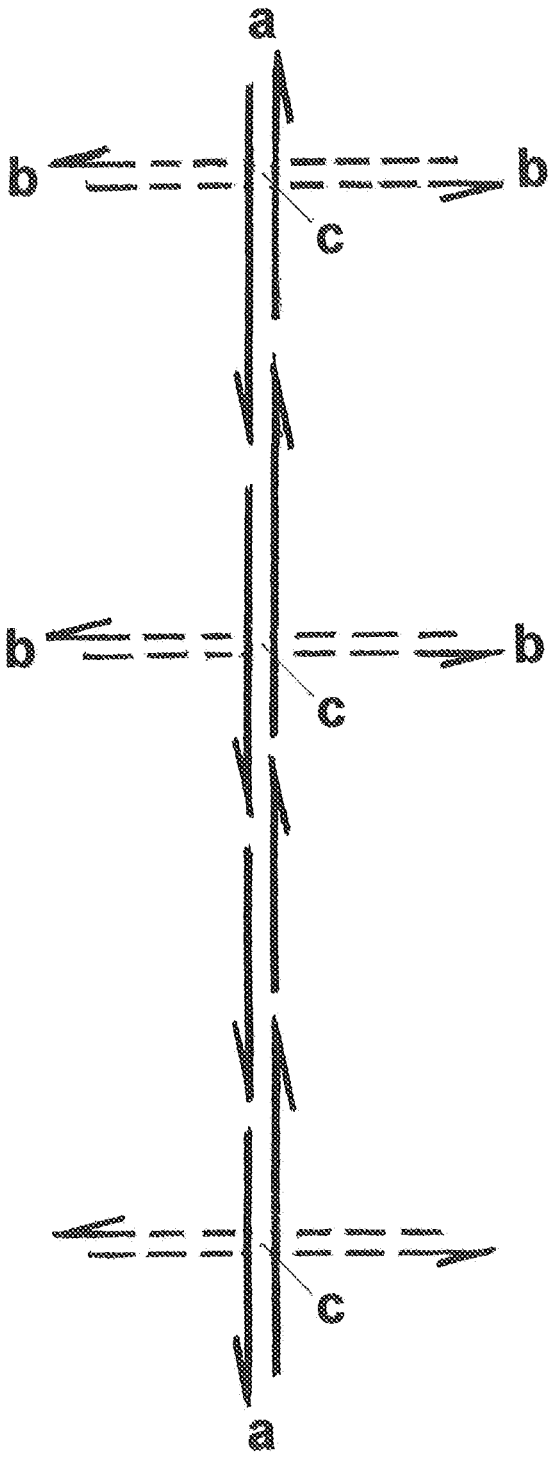
FIG. 1: Flow Boulevard Corridor with Crossing Arterials (roadways)

This single street Flow Boulevard corridor (a) is depicted as a lineal configuration with arrows pointed in two opposing directions depicting right hand drive of vehicles in the two directions. The diagram then shows three arterials (b) crossing the Flow Boulevard (FB) with arrows again depicting traffic flow; however they could be one way streets in a given street pattern. The main point to make is that these intersections are at grade along with the Flow Boulevard (FB) and make an interruption in the flow of traffic of the FB by doing so. Each intersection of the (a) and (b) streets is called out as an "On Module" intersection (c). These intersections would probably have the standard signalization that cover all the various traffic movements found in a normal urban at grade intersection (see FIG. 4 for clarity). The main idea behind this drawing is that the On Module intersections are spaced and timed to perform with a general speed of travel so that On Module intersection signals have a common signal cycle that would ideally occur at the same time throughout the single street FB and facilitate continuous flow of traffic in both directions.

FIG. 2: FB Packs and Gaps through the Intersections

There are two diagrams in FIG. 2 which depict two different signal phases of the On Module Intersection (c) and the formation of packs (P) of vehicles and the gaps (G) between them on a basic Flow Boulevard (a) segment of roadway. Diagram 2X shows the green phase of the signal cycle where the flowing packs (P) of vehicles are passing through the On Module intersections (c) by essentially entering and exiting those intersections at the same time from both of the opposing directions without stopping as they flow through the corridor. To accomplish this function the packs have been formed by lane signal prompting as described in FIG. 5. In the same manner the gaps between the flowing packs are also formed by lane signal prompting. So in Diagram 2Y what is depicted is the signal phase where the arterial traffic is crossing through those gaps formed on the FB. This is the arterial traffic (b) performing its movement of traffic during the red signal phase of the FB signal cycle and does not interrupt the flow of the continuously flowing FB packs while doing so because the gaps are formed to provide for the time it takes for the cross arterial traffic to clear.

The packs (P) are given "compaction" prompting given the relative amount of travel demand through the day. Light traffic receives greater spacing between vehicles and heavy traffic during peak travel periods receive closer spacing. The lane traffic signal prompting is a separate signal system from the On Module Intersection (c) signalization but of course would have the coordination that makes the packs (P) and the gaps (G) perform appropriately at the On Module Intersections. The On Module Intersection signals are a kind of "fail safe" set of signals that would govern ill-formed packs and gaps. These two diagrams show the basics of how the continuous flowing of the packs of vehicles is achieved and how the stop and go driving of the cross traffic of the intersecting arterials do not interrupt those flowing pack of vehicles on the FB.

FIG. 3: Turning Movements between the FB and Side Streets

This figure is to show that there is need to provide turning movements between the On Module Intersections (c) to serve the needs of mobility for the adjacent community and the FB median (m) serves to control such vehicular movements. Even though the On Module Intersections serve arterials and would account for the majority of cross traffic the intervening traffic movements of side streets in the figure can serve many movements that would otherwise burden the On Module intersections. So these intervening traffic movements provide access to and from the FB not only for the general use of adjacent land uses but also for goods delivery and emergency vehicle access.

Starting with FIG. 3X the traffic movement between a side street (s1) is making a "T" intersection with the FB (a) allowing right turns from the FB into the side street and a right out of the side street onto the FB. A traffic movement from side street (s2) allows a right turn from the FB into the side street and a left turn from the side street to a receiving pocket in the FB median and to queue to complete the turn into the FB flow of traffic. Side street (s3) can receive a left turn from the FB median turn pocket and a vehicle from side street (s3) can make a right turn on to the FB.

Continuing on FIG. 3Y a side street (s4) can receive a right turn from the FB and a vehicle from (s4) can make a right on to the FB or continue on to a pocket in the median for the purpose of making a left turn into a side street (s4) or make a "U" turn if allowed to reverse direction onto the FB. A side street (s5) can receive right turns from the FB and vehicles can make a right turn onto the FB as well as receive left turns from the median and originate left turns to the median pocket in order to queue to then move into the FB flow of traffic. Side street (s6) can receive a right turn from the FB and originate a right turn into the FB which can then either continue on the FB or merge left to an intersection left turn pocket to either turn left or make a "U" turn to reverse direction on the FB. Side street (s7) can be separated from connecting to the FB by being made into a cul-de-sac.

Figure 4:
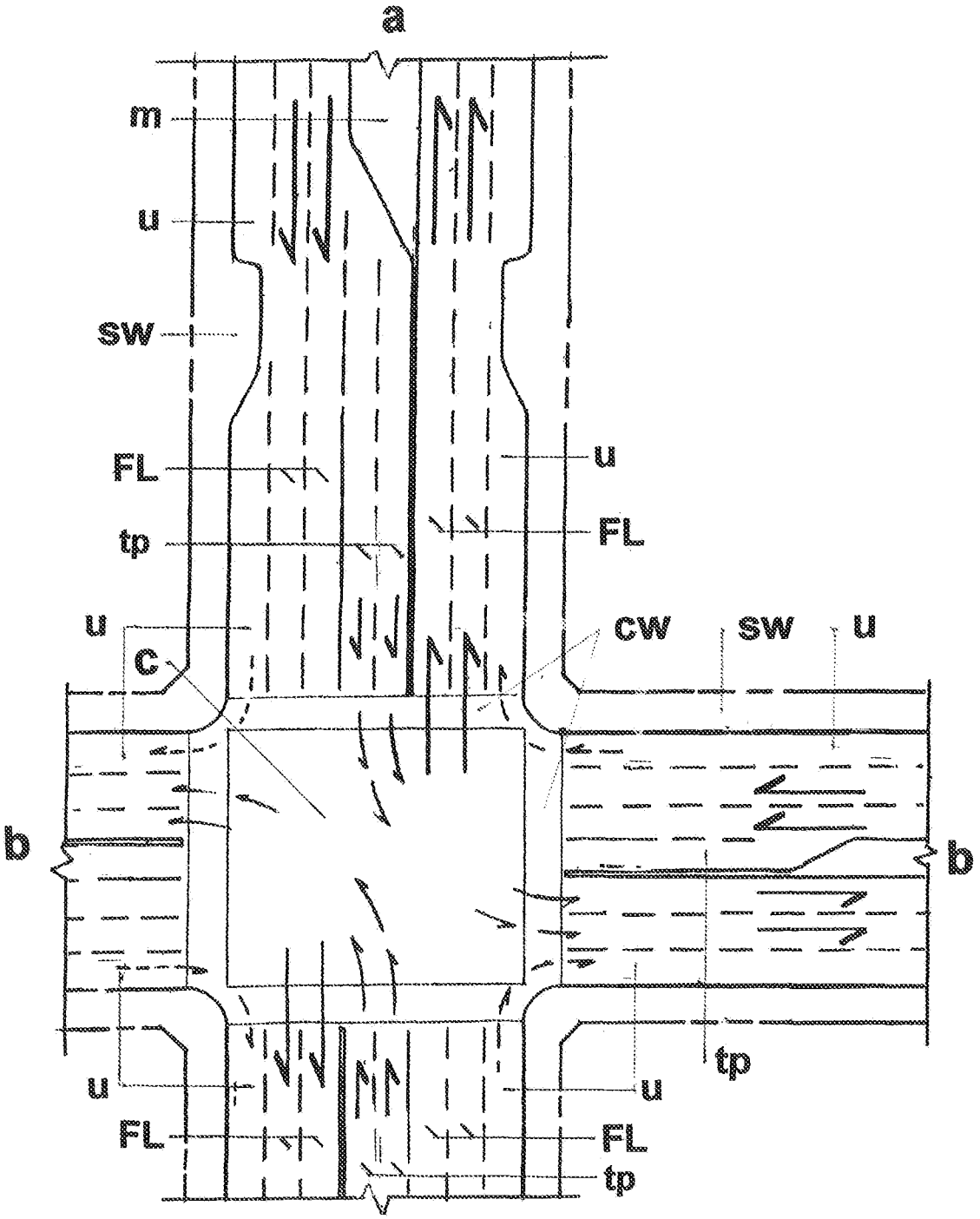

FIG. 4: The On Module Intersection of the Flow Boulevard and a Cross Street

The On Module Intersection (c) looks like the typical on grade intersection that can be found in many an urban location and as a matter of fact it is like them. What is different is its operation where there are FB flowing opposing packs (P) of vehicles arriving simultaneously at the intersection during the green signal period, which gives continuous flowing traffic on the FB corridor (a), and during the red FB signal period there are gaps (G) between those packs that allow the cross arterial (b) traffic (likely stop and go traffic) to cross through the FB gap thus completing the signal cycle and the crossing of the perpendicular (or other angle) flows of traffic to occur.

The FB would have one or more flowing lanes (FL) in each direction and a median (m) is required to provide a queue lane (or lanes) for left turns (tp) from the FB alignment onto the cross street. The cross street would have the same lane continuity for crossing the FB to be provided and pockets for making left turns onto the FB as well as provision for right turns onto the FB from curb lanes (u). Next is the provision for pedestrians to cross the FB (a) and crossing arterial/roadway (b). Here there are crosswalks (cw) and of course a system of sidewalks (sw).

Figure 5:
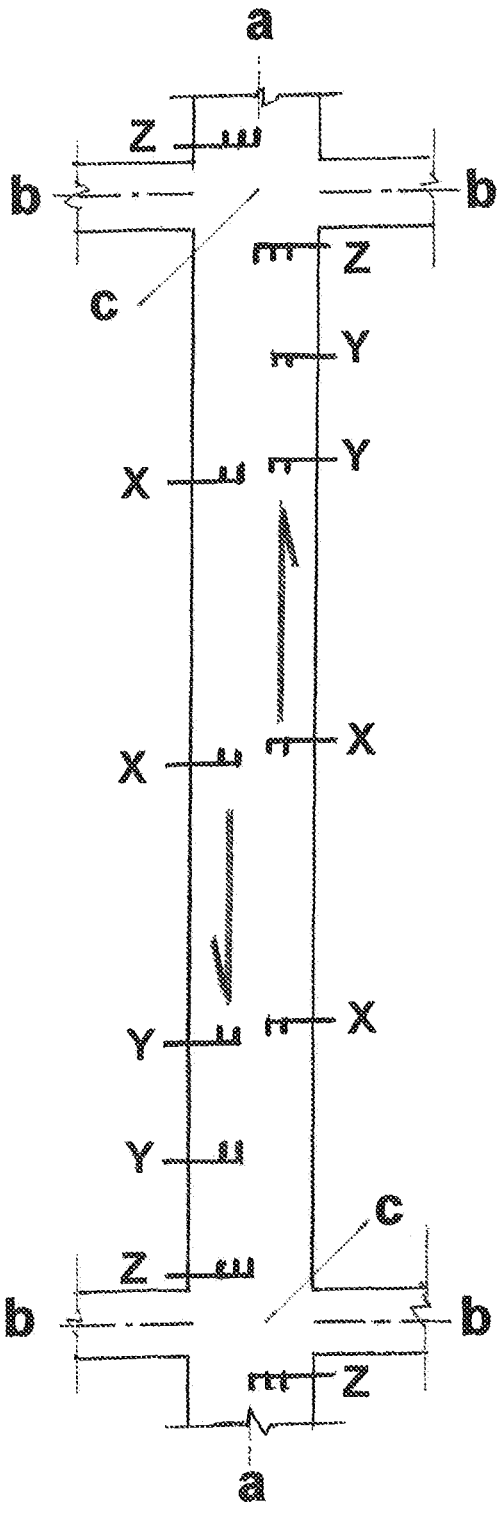

FIG. 5: Diagrammatic Arrangement of Lane Traffic Signals

Lane signals (X, Y and Z) are the follow through or enforcement of the Flow Boulevard concept of formed packs and gaps that allow the best average given speed and the most optimum capacity to be achieved in that urban interrupted flow facility. Lane signals for each lane along the FB (a) between the crossing streets (b) at On Module intersections (c) have differentiated jobs according to their position to assure that the formation and spacing of vehicles will be appropriate to allow the vehicular packs and gaps in between them through the intersections (c) appropriately.

The "X" position of the lane traffic signals would have the basic purpose of maintaining the given speed of traffic flow for that segment of FB and the amount of compactness given the current travel demand. The "Y" position lane traffic signals are a more intense use of forming packs and the following gaps so that there will be no vehicles out of place when the pack enters the On Module intersection. The "Z" position lane traffic signals have an even greater purpose of controlling the packs and gaps of the FB in that this is the last prompting that can be made before the On Module signal at (c).

Figure 6:
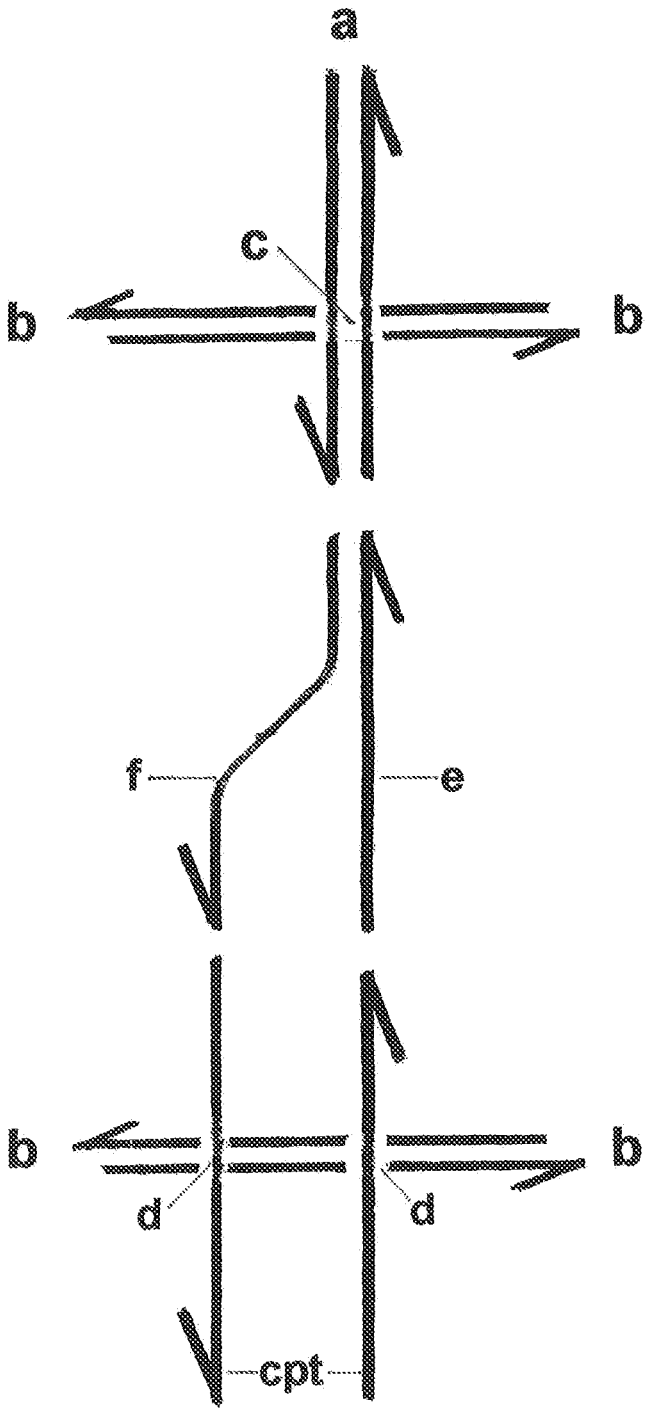

FIG. 6: A FB Interchange Connecting a Single Street FB to a Couplet End to End This is a very likely connection to take place because these are common patterns of streets found in urban street layouts. Single street main corridors and parallel streets in street grids.

On the upper side of the image of FIG. 6 is the single street FB (a) and has an On Module intersection (c) as the connection point between the two-way street of the FB and the two one-way streets (e) and (f) of the couplet (cpt). It should be noted that on the directional flow of the couplet, element (e), prior to going into the single street FB at the On Module Intersection (c) needs to have its traffic to be prompted into the required packs and gaps so that the single street FB works at its initial On Module intersection (c). This is in contrast to the street element (f) where the directional flow of traffic has come out of the single street FB and may or may not have progressive traffic signalization needing the organization of traffic to work well with successive intersections.

Whether the intersections of the couplet street elements are set for flowing traffic affects the requirements for the signals at each of the intersections (d) between the couplet and that arterial (b).

Figure 7:
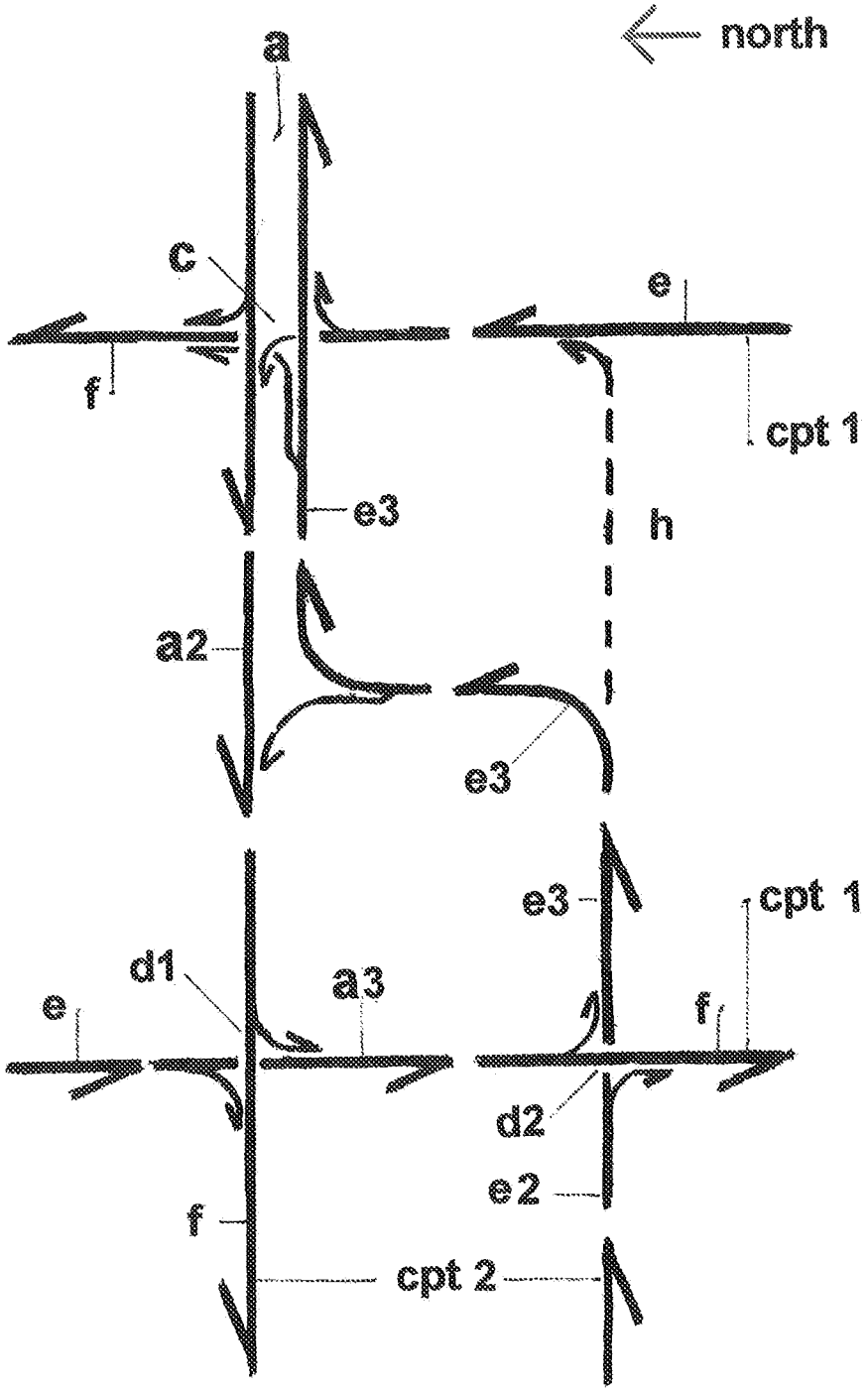

FIG. 7: A FB Interchange Connecting a Single Street FB to a Couplet Side

The couplet one-way pair of streets (cpt-1) is separated by several blocks (about 2000 feet in this configuration). This interchange is essentially a "T" intersection with the single street FB (a) coming in from the east (top side of the image) into the couplet (cpt 1) running across the page. Starting at the top of the image the first couplet street encountered by the FB (a) will need an On Module Intersection (c) in order to have flowing traffic to and from the FB (a).

It should be recognized that the couplet itself may or may not have flowing traffic in the form of packs and gaps with progressive signalization. At a minimum however the northerly traffic flow (e) on (cpt 1) needs pack and gap organization so that the On Module Intersection (c) works effectively by crossing the westerly flow of traffic through the gap of that northerly flowing traffic from (e). Traffic on roadway (f) may or may not be flowing with packs and gaps. The same is true for the southerly flow of traffic in (cpt 1).

If the couplet (cpt-1) is to be continuous flowing and linked to the single street FB (a) then specific design requirements for the vehicular speed of travel and associated distances involved between intersections must be adhered to. A flowing interchange requires the specific engineering of volumes of traffic, speeds of travel, number of lanes, etcetera, as opposed to vehicles that come from streets with stop and go driving where those associated signals would simply comply with the requirements of matching the resulting volume of traffic that conform to the flows of the streets with flowing traffic. To express these requirements of having an interchange with flowing traffic, this FIG. 7 configuration will have the more stringent set of requirements explained in the Detailed Description of the Invention section of this Specification.

To continue with the FIG. 7 callout from the On Module Intersection (c) heading west, it goes like this. On that westerly flow on street (a2), which would have to be of sufficient length for the pack to function well enough to avoid interruption at (d1), there is also a southerly flow from (cpt 1) which will share the signal cycle time at (d1). The flow from (a2) that turns south on to (a 3) will have a portion of the signal cycle at (d 2) as will the southerly flow from (cpt 1) traffic as well as making a portion of the signal cycle at (d2) to allow easterly flow from (cpt 2) at intersection (d 2).

Intersection d2 can potentially allow flowing vehicles south from both (cpt 1) and the southerly flow from (a 2) but the flow east of (cpt 2) from (e2) would not be a participant in flowing traffic in the interchange. That flow would be a low volume of traffic and have stop and go traffic. Such an intersection would have to take into account the travel demand that was placed from all of the directions acting on intersection d2. The flow east from intersection d2 is to be a rather weak flow of vehicles. That is why the interchange is considered as a "T" shaped interchange in that the FB (a) and the couplet (cpt 1) have the heavy travel demand that is to be solved for in that connection of streets and their respective traffic flows.

The roadway combined segments (e3) in FIG. 7 would be timed and given a vehicular speed to then pass through intersection (c) in order to continue east on the single street FB (a) east. Intersection (c) could be burdened with a complexity of turning movements requiring extra lanes and possible signal time would be called for. So in this regard it is suggested that road element (h) can be made to relieve the left turn movement on to north bound (e) on (cpt 1) by its inclusion.

FIG. 8; A FB Interchange Connecting a Single Street FB to a Crossing Couplet The figure portrays a likely urban street condition where the couplet being crossed by the FB would be separated by one or two city blocks with a distance of about 700 feet. The single street FB would have an On Module Intersection that was essentially split into two half On Module (OM) intersections to connect to the separated pair of streets. FIG. 8A shows two separated arterials (b cpt) and the altered "half" OM intersections (c2) with the grade separated overpasses (RB, ramps and bridge) which allow each direction of flowing traffic that can't be synchronized with two closely spaced intersections at grade to be synchronized, by just having one intersection to occur per direction to cross at grade in order to keep vehicular packs flowing at the grade intersection. At each of the intersections synchronization is made with one of the FB directions of flow with one of the couplet streets at grade. This allows correct pack and gaps to be spaced as well as the turning movements between the cross traffic and the FB and each of the couplet streets at grade. A slight adjustment would occur to the timing or speed of the FB vehicular flows because of the difference of spacing regarding the couplet streets and the two opposing flows of the single street FB in order to have that work for the corridor timing and spacing of OM intersections.

Continuing with the called out elements; in FIG. 8B the FB flow lanes (FL) are called out for each direction of travel and the median space (m) which also gives space for the left turn pockets (tp) at each half On Module Intersection (c2) where the arterial couplet street (b cpt) crosses. FIG. 8B gives a more detailed look at the relationship of roadway elements with a cutaway of the ramps and bridge to more clearly see relationships at grade level. The more detailed Figure shows a typical callout of lanes where lanes 1 and 2 are the flowing lanes and at the intersections, the number 3 lane is a convenient bypass lane (pi) for receiving left turns and for traffic passing curb lane (u) uses in lane number 4. The arrows show the direction of traffic flow and some turning movements.

DETAILED DESCRIPTION OF THE INVENTION

What defines and characterizes a Flow Boulevard is that it can be a roadway improvement that makes a much higher capacity and better operation of traffic than the typical urban interrupted flow roadway facility. It will do that by optimizing the vehicular flow on the Flow Boulevard (FB) and minimize both the interruptions along the FB corridor while maintaining the crossing traffic operation. Specifically the FB can allow a significant amount of additional vehicles to flow without stopping along its corridor. A FB can do that in both directions of traffic flow along the corridor at the same time and this is one of its major contributions. A Flow Boulevard roadway can become a system that not only allows vehicles to flow continuously through corridors but also allows FB corridors to be strung together end to end or through other connections in order to connect to other different street and highway networks to make significant transportation improvements in capacity for large areas of the urban context.

To distinguish the Flow Boulevard from the average urban boulevard is that of comparing a highly organized roadway system for vehicular movement with one that is essentially much less organized. Most urban areas have evolved from simple beginnings and have retained aspects of earlier low density roadway service with aspects of design that interrupt the flow of vehicles. The main difference is that the FB system removes the interruptions and applies a roadway architecture that includes spacing and timing of intersections along with coordinated movements and design controls that greatly reduces the interruptions to vehicular flow. Much greater capacity to move vehicles can be obtained from existing regular boulevard rights of way.

Another distinction between the older less organized and the newer organized FB is in reference to the scale of mobility that it serves. The FB made into a system essentially takes a legacy roadway and vehicular system of cars, buses and trucks in a medium density urban or suburban context and makes improvements to it so it can become a new class of urban high capacity facility for transportation. The pattern of roadways can be made into a connection of corridors with the new level of higher capacity to serve a greater land use area and its greater travel demand. Many urban areas have failing existing boulevards that are unable to serve the increase in travel demand that has grown with development over the years. The FB improvement is a way of providing the extra capacity that is required to serve the extra travel demand that has developed. That new class of urban transportation service would be between that of a regular boulevard and that of a freeway on a lane per lane comparison of capacity.

Alternatively by its ability to make high capacity in just a few lanes, or even one lane in each direction, it can allow roadway space to be given to other modes of travel such as BRT transit, biking and walking in the same right of way (ROW) while maintaining a good level of service for vehicular traffic. This then is a way to add urban short trip expanded service and amenity at the neighborhood scale. This would also be a way to improve the operation of bus rapid transit (BRT) by either making exclusive BRT lanes or by simply taking advantage of the aspect that buses on a FB facility with flowing traffic can improve average speed through a corridor among mixed traffic modes. All this improvement can essentially take place within existing street right of ways so that there is little or no increase in width to streets. This avoids impacts to existing adjacent land uses or dramatically lessening what might be a very expensive project with many severe impacts given with some other way of adding additional capacity to a corridor.

The first question to answer is how does the FB increase capacity in both directions at the same time. The typical way to get flowing traffic on an urban street with signals is to introduce progressive signalization so that signals will turn green as the traffic approaches those intersections. That allows traffic "to hit" green signals in that line of progressively arranged signaled intersections. The problem is that on a street with two way traffic it works in just the one direction and can severely penalize the traffic in the opposing traffic direction by creating just the opposite effect which is signalization where red lights are hit much more often than green signal time.

An example of the progressive signal condition on a street with two way traffic works like this. Starting from a given intersection "A" in order to be able to get a green light at the next intersection "B" for that group of vehicles, the next signal cycle at intersection "B" is advanced in the time it takes the group of vehicles to reach that next intersection. As an example, with vehicles set to average 30 mph on the given street and the next intersection "B" is 2640 feet away (a half mile), by dividing that distance by 44 feet/second (30 mph speed) would give 60 seconds to reach intersection "B". So to get flowing traffic with progressive signals for that direction of traffic, the signal cycle at intersection "B" is advanced 60 seconds so that it turns green when the traffic from "A" reaches "B".

However the signal cycle at intersection "B" would also start for the opposing traffic at the same time in order to go towards intersection "A". Given a typical 90 second signal cycle where the green light time for moving and red light time for cross traffic are equally divided (45 seconds), the effect on the opposing traffic going from "B" to "A" can be calculated. The opposing traffic direction starts out from "B" towards "A" when the progressively timed traffic from "A" reaches "B". So in 60 seconds the opposing traffic will reach intersection "A", which having the 60 second progressively advanced signal cycle to work against, that signal at "A" will have been red for 15 seconds and will have 30 seconds more red signal time before it turns green for that opposing traffic to proceed. With a signal spacing of 1760 feet (one third mile) and a 40 second progressive signal for the "A" to "B" direction, the opposing traffic going from "B" to "A" reaches the signal when it has 5 seconds of green to go before turning red for 45 seconds. With a signal spacing of 1340 feet (one quarter mile) and a 30 second progressive signal for the "A" to "B" direction, the opposing traffic going from "B" to "A" reaches the signal when it has 15 more seconds of green time followed by 45 seconds of red signal. If those same distances, and signal cycles remain on successive signals, the opposing traffic will a lot of red signal time. The opposing traffic to the progressively timed traffic direction is basically working against a timing mechanism of signals that will produce red lights and will penalize that opposing traffic movement. Various short and mixed distances will only produce differing but similar results of more red signal time than green signal time.

However, if the intersections where set for a travel speed and distance which related to the signal cycle, then you would have the FB condition where flowing traffic can hit green lights in both direction at the same time. So with 44 feet per second (30 mph) times 90 seconds (for each signal cycle) would make a distance of 3960 feet or three quarters of a mile. Then you would have the beginnings of a FB condition where the intersection signals would be regular and you would not need to have progressive signalization and you would not have opposing traffic penalized. Both directions of traffic flow would be hitting green signals as it proceeded through that corridor. From that point if the other organizational elements of the FB that greatly reduce interruptions of traffic flow were employed, and the corridor had the transitions and interchanges that allow connections to other street patterns in an appropriate manner, you would have a FB.

Another major organizing aspect of the FB is to arrange intersections from a regular and good distance from each other. A constant distance module is the objective for the corridor, generally a module from about three quarters of a mile to one and a quarter of a mile on that given single street with two way traffic. The comparatively long distance, is different from many urban streets which have signaled intersections at quarter mile separations and some even as close as one eighth mile and of course mixed distances of separations as well all of which makes the possibility of making organized traffic flow essentially impossible. Short distances reduce the objective of developing long packs of flowing vehicles which is partly how vehicular high capacity is attained along with the continuous flow of vehicles through the corridor. The constancy of speed and regular distances helps in maintaining standards of safety as well.

The optimization of throughput on the single street FB and of accommodating cross traffic in the urban context requires that a distance between crossing intersections be made where the most vehicles can flow in both directions on the FB and to also accommodate the cross traffic travel demand which is generated from the adjacent land use to cross the FB corridor. Typically a FB can find application in a medium density urban development of between 3,000 and even 12,000 people per square mile that mainly uses vehicular modes of travel.

As an example of what would appear to satisfy these requirements would be a suburban context at the low density range and an existing urban developed area at the upper population range that has evolved from a suburban pattern of boulevards. Intersections in both these population ranges can be found where arterials at a distance for cross traffic on approximately a distance of one mile have often been laid out. So for the sake of general explanation in the description of this innovation, the time of 2 minutes signal cycles and 30 mph as the speed to be maintained between intersections will be used in the examples being described for the FB corridor as in FIG. 1 roadway (a).

The intersections at the one mile arterial spacing that often relates to crossing roadways (b) layouts for medium density urban land use in these examples will be said to be "On Module". Of course, when designing for a specific location the specific layout of arterials, or other roadways, have the determining context for choosing a standard distance to use for On Module intersections for the corridor. Then by having the single street FB that can transition to other street patterns and corridors then allows a system to be strung together over a large area by appropriately connecting differing street patterns.

Again referring to Figure one, the FB is shown as roadway (a) and the crossing traffic roadways are shown as roadway (b) at intersection labeled (c). The intersections (c) will be called On Module Intersections due to how they structure the FB with their repeating spacing and timing as well as this is where the cross traffic mainly takes place. Whereas they ideally are meant to be rather regular in their distances apart, some variation in separation can be accommodated by using "adjustments" to make them operate correctly.

As can be seen in FIG. 1 there is a distance variation between the two segments of FB shown. The top portion of the image shows a shorter distance between the two (c) intersections than the distance shown in the lower part of the image. This variation can be made up with a change in speed of travel between the different lengths of travel between intersections so that all the On Module Intersections operate essentially at the same time. The shorter distance would have a slower speed and/or the longer distance would have a faster speed depending on which segments of FB needed to be brought into conformance with the OM intersections of the corridor.

At issue is the segment of FB with the shorter distance between intersections because it can become the more likely determinant of capacity for this length of FB and conflict with objectives of capacity for the corridor. However there is another important determinant of capacity and that is the distance between vehicles that are flowing in that segment of the FB. Closer spacing between vehicles would be another way to deal with a potential loss of capacity where a shorter spacing of On Module (OM) intersections occurs. The shorter segments could have closer spacing between vehicles and slower speed to equal the longer distance and regular speed and therefore be capable of the same capacity by that adjustment.

Whereas there are other variables that can make up for not having a constant order of OM intersections, such as adding or subtracting lanes or having transitions to slower or faster speeds over multiple segments of the corridor to relate to differing adjacent land uses or travel demand these adaptations should be generally avoided regarding good design in respects of performance, safety, regularity, route continuity and such related subjects that bring complication to the design and construction. In other words there must be a good reason and method of dealing with the variations in order to do that. When such OM intersections (c) no longer change at the same time, they all need to be engineered for that with the variables of distance, speed, timing of intersections number of lanes, amount of traffic flowing and consideration for other traffic operations which affect traffic flow so that they are not in conflict with the objective of the FB.

What is presented here in the discussion below is in a sense the basic or ideal objective of the FB urban roadway in order to express the principles of the FB innovation.

Variations are potentially many and are mentioned as an acknowledgement that practice in the real world can be varied and at times demand that variations and work a rounds make sense overall.

FIG. 2 expresses the principle of getting flowing traffic organized to pass through the On Module (OM) intersections at the same time so that the flowing traffic can become continuously flowing through the corridor in both directions at the same time. Making well-formed Packs (P) of vehicles and the Gaps (G) between them is a key traffic organizational principle in the optimization of the Flow Boulevard operation in order to obtain the high capacity and high level of service (LOS) as well as the way to provide continuous flow of traffic on the FB in the single street right of way on an urban interrupted street. With the corridor having received a standard framework of OM intersections (c) to form a constant for the corridor (within adjustable limits), it is then the objective to organize vehicles to optimize the capacity for the groups of flowing vehicles in the corridor. The distance and timing between the two OM intersections that comprise one segment of FB is based upon one signal cycle operation comprised of lengths of one Pack (P) and one Gap (G) together for the typical segment of FB.

This step is made by forming Packs of flowing vehicles separated by Gaps between them so that the entire length of FB corridor is organized in a P, G, P, G, P, G, etcetera, organization. That pattern in both directions of travel is to make flowing vehicles continuous through the corridor without stopping. FIG. 2 shows the two basic phases of traffic flow through a typical segment of FB and in turn applies for the entire length of corridor. FIG. 2X shows the Packs flowing through the OM intersections (c) that are spaced and timed to allow the continuous flow of traffic on the FB. FIG. 2Y shows the opportunity to have cross traffic going through the OM intersection by the separation Gap (G) between Packs (P). This is the basic organization that allows continuous flow of the Packs of traffic on the FB and the cross traffic to occur through the Gaps between them on the "interrupted urban street" FB.

The discussion continues with our general example of timing and spacing of the OM intersection with a distance of one mile between them and the average vehicular speed will be 30 mph. That makes a signal cycle at the OM intersection of two minutes which in this example will be divided into a basic FB green period of 72 seconds and a FB red period of 48 seconds. Packs 70 seconds long are nice long packs of flowing vehicles that result in a high capacity corridor. A typical lane might be as high as 1200 vehicles per lane per hour which is about double the typical urban stop and go traffic on a typical moderately disorganized streets with level of service "C". And ordinarily the number of lanes is to be matched in number in each direction.

Having a closer look at the flowing Pack of vehicles in the same direction, it is likely that the vehicles are a bit off-set from one to the other to allow vehicles the opportunity to change lanes. And a given single street Flow Boulevard will have a minimum of at least two of these On Module intersections and a segment of the Flow Boulevard between them. Given the congestion that is building in urban areas at this time it is very likely that long stretches of single street Flow Boulevards could be strung together end to end or connected with segments of the "sister" of the single street FB, that of a couplet configuration, either with flowing or stop and go traffic, to respond to the growth in urban vehicular travel demand.

The OM intersections are not the only elements of FB design that deal with the adjacent land use traffic. Here as well there needs to be design given to adjacent traffic movement between the OM intersections along the FB corridor, to eliminate the interruption that can take place to the flowing Packs of vehicles. FIG. 3 shows adjacent side streets related to the FB. The turning movements however are given design restrictions so that those turning movements off or on to the FB from side streets are done with the thought in mind to keep the integrity of compact Packs and clear Gaps with the resulting high vehicular capacity.

Before getting to the vehicular movements involving the side streets along the FB in FIG. 3, it is necessary to mention that pedestrian crosswalks for crossing of the FB can as well be made to the median (m) areas by having signalized crosswalks for pedestrians. The median areas become waiting areas for pedestrians to gain the opportunity for safe crossing through the gaps of the FB flowing traffic. These crossings would be organized with vehicular crossing movement signalization. It is intended that these crosswalks along with the OM intersection crosswalks would provide adequate pedestrian mobility in most instances. Bike lanes and FB crossings for cyclists would merit careful design integration with both the vehicular and the pedestrian means of crossing and travel along the corridor. Good design would require clear markings and signage along with the various signals for a successful multi-modal FB corridor.

In FIG. 3 there are seven side street conditions to be discussed. Beginning with the FIG. 3X group of conditions finds S1, which is a basic "T" intersection with the FB. This is where right turns into and right turns off of the FB can be made. The median is a barrier so that left turns cannot be made from the S1 side street on to the FB. This is so that even though entering the FB in a Gap period, it is likely that the opposing traffic on the other side of the median would probably not be in a Gap period. Gap periods line up at OM intersections not in the portions of FB between OM intersections. Condition S2 is where a left turning movement can be made to enter the FB from a side street. A special left turn pocket is provided in the median to receive the vehicle movement from the side street. The pocket allows the vehicle to wait for a safe time to enter the FB and not disturb the flowing Packs of vehicles. In lower capacity time periods, at the beginning of the corridor's development or other reason for example, the final entry into the FB flow can be on a driver's decision. When the FB is in a high capacity period of development, there is probably need to have a signal light to provide the go ahead to finalize the entry into the FB flow. The condition of S3 is the compliment of S2 in that this condition allows a left turn from the FB to a side street. Again a queue is provided in the form of the turning pocket in the median as a necessary first step in making a safe turn across the Gap in the opposing traffic in order to turn into the side street S3.

In FIG. 3Y the condition S4 is a two step movement that combines the steps of S2 and S3 resulting in effectively in a crossing of the FB from side street to side street and the possibility of a "u" turn is also suggested. These are more complicated movements and may not serve the high capacity priority of the FB very well regarding safety and may not be turning movements to be encouraged. The amount of traffic and the limited median space and roadway width may also be a factor in providing such a turning movement to be accommodated in the FB design. However in such streets where there is ample width there could be multiple turning pocket lanes and length with signals to provide for those particular demands. Design of these turning movements are important in the success of the FB in meeting the objectives of appropriate mobility in the corridor. What is being considered here is essentially that side streets may present fairly strong demands for vehicles to cross the FB. It may be a good thing to accommodate these demands at mid distance positions rather than making all such crossing movements to only occur at OM intersections. In this regard a very strong side street demand, which is not shown, could be accommodated with a grade separated overpass and with simple right turns into the FB and off of the FB a grade for some traffic movements. To accommodate left turns on to and off of the FB requires a significant set of median left turn pockets that may not be easily available regarding roadway space for such.

Condition S5 is also a design response to the providing of more turning movement options for the designer of segments of a FB. In S5 both left turn opportunities are provided with pocket queues for entering or exiting the FB. Here it would probably be best to have light signals to control those movements.

To continue with the remaining side street conditions, S6 is another more complicated vehicular movement involved in several lane changes to reach a turning pocket at an OM interchange where both a left turn and a "U" turn might be made. Allowing greater length of travel from where the vehicle enters the FB to reach the OM turning pocket would be a suspect design consideration. And the final side street condition S7 shown comes under the headings of both safety, by eliminating turns altogether and of baring traffic from the FB into the adjacent land use area. From the stand point of FB operation it may be safety for not allowing interruption from the adjacent land use area to occur. From the standpoint of the adjacent land use it may be the objective to omit traffic to enter there. Therefore a cul-de-sac of the side street is a possible design consideration as well.

Considering FB objectives; a design issue that is to be recognized, is that in a high capacity corridor there needs to be sensitivity to controlling vehicular movements whether it be for forming well-formed Packs of flowing vehicles or for making sure interruptions due to turning movements and similar elements of potential interruption will not occur. This issue will be referred to below to a greater extent, but it can be said first that both the vehicle and the roadway may be on a course for greater use of technology and the interrelationship of such. The FB is probably a very good step forward in providing a roadway architecture that lends itself to such an interrelationship of roadway and vehicle technologies. The reference being made is that digitalization would be occurring between the two. Vehicles are developing greater use of digital controls and operation with programs governing such. It would be practical for roadways to be more organized with digital operations so that roadways provide a compatibility digitized vehicle capability so that the two working as a system making overall transportation, mobility, and safety more effective.

As seen in FIG. 4, even though the OM intersection (c) holds a prominent role in the operation of the single street FB, it is in itself a standard kind of basic intersection that is found in the typical urban intersections of urban roadways at grade. Here as well, there would be the regular sort of traffic signal lights used for both the FB (a) and the crossing roadway (b) at the OM intersection (c), which control all the crossing and turning movements that are being made. What gives the intersection its prominent role is its location in the corridor and when traffic arrives at it as the aspects are discussed in FIGS. 1 and 2 descriptions.

What is different is the form in which traffic on the FB (a) arrives at the intersection and when. The traffic on the FB arrives in flowing Packs of vehicles and have been timed and spaced as discussed about with FIG. 2. Traffic flows need not stop as may be the usual case with stop and go traffic. Further the Packs are given a greater period of time to flow through the OM intersection (c) than the Gaps that afford time for cross traffic to occur for the (b) crossing the FB. With the basic example that is being used of a 2 minute signal cycle for the intersection, the FB flow of traffic would have the greater share of those 120 seconds. In our example it could be 72 seconds for the FB flowing phase and 48 seconds for the cross traffic arterial phase (a 60% to 40% split). The crossing roadway portion of traffic could be more than in the FB but the best way to solve that would be by increasing the number of lanes for cross traffic so that it does not severely lessen the capacity of the FB. The main optimization of traffic flow in the FB direction is that it is continuously flowing not losing time for stopping and acceleration, the packs are closely formed giving optimum spacing giving high capacity and the duration of flow is given the greater period in which to flow. Those design guidelines should be adhered to.

A median (m) is required for a FB (a) and is used here to provide left turn pockets (tp) to allow left turns off the FB. Likewise the crossing roadway (b) would likely have a set of left turn pockets (tp), or such opportunity to turn left to enter the FB. The arterial is shown as a two way street but of course it could be a one way street. A question is raised of how the normal pairing of streets with one way traffic is dealt with, but will not be addressed until a similar condition is discussed on FIG. 8.

FB flowing lanes (FL) are called out to distinguish them from other lane usage such as the turning pockets (tp), curb lanes (u) used for a number of functions and as will be seen in FIG. 8 there was a need for a passing lane (pi) in that example design (not shown here in FIG. 4).

Along the FB corridor there is the need for traffic controls to provide the well-formed Packs and Gaps, and appropriate speeds of vehicles so there is not a loss in capacity by stop and go traffic and other interruptions. Regarding the roadway there is the mechanism of traffic signals (think "old tech") and there is the roadway that is evolving towards a "communication dialog" between the roadway and vehicles. At the same time vehicles are evolving with digital controls and operation. It is worth some discussion of this in that it will be a part of a future FB system and the FB should be supportive in the organization of both the vehicle and the roadway evolution into a safe and efficient system.

At the same time vehicles are evolving with digital controls and operation, traffic signal systems are becoming more computerized with different traffic light systems by different cities and states with differing levels of technological sophistication, but they still use traffic signals to coordinate with. There are advancing roadways connected to computerized systems with traffic sensing and programmable traffic signal controls. The roadway evolution and the vehicle evolution each have the objective to make transportation more efficient and safer.

Vehicle mechanical systems are being controlled by computer systems; braking, acceleration, steering and sensing of the surrounding environment they are in. Several vehicle manufactures are developing self-driving vehicles bringing human sensibilities into the realm of the vehicle itself. Where a self-driving vehicle can drive itself, it is not unreasonable that a roadway will be able to tell the vehicle how to drive in the traffic it finds itself, in order to best get it to its destination. And one can see where the roadway will be able to interact with a self-driving vehicle and multiple vehicles to guide them to their destination by making traffic opportunities for lane changes and the like to do so. That may be some sort of ideal where a vehicle and the roadway are a combined system but it would be a long time until all the vehicles would be capable and drivers would not be themselves driving on roadways.

With driver controlled vehicles and the emerging self-driving vehicles that will be entering the traffic mix, it is safe to say that visible systems for drivers will remain as part of the control system in organizing traffic for some time. Roadways should be able to express the means of controlling traffic whether it is to drivers through signals or to self-driving vehicles thru electronic communications. As the roadway condition becomes more complex there may be the need to qualify the driver and the self-driving vehicle as to whether it is qualified to be on an FB. Yet traffic signals are still the common system for drivers to use and self-driving vehicles can use them too. At some point there should be some standardization of systems and the FB may be a good example of such in making a roadway more efficient, predictable and safer.

Stepping back for a moment to a beginning level of FB roadway development; the controls for a low travel demand FB control system can be as sparse as to use traffic signals at the OM intersections and simple signage for other turning movements and vehicle spacing by leaving the choices of such control to be self-organized by drivers versed in the methods of using the FB. This relates to evolving a FB corridor from light traffic beginnings. Yet in urban areas where traffic corridors are already failing with too much traffic and there is need for higher capacity to eliminate congestion and gridlock more signalized communication is necessary. So vehicle drivers will be on roadways for the foreseeable future as will traffic signals. Yet there is still the need to improve and organize traffic on roadways as part of the improvement in transportation. Here are some examples of expected sophistication that traffic controls may include as complexity is encountered.

Include the advantages of wireless communication for communicating directly between roadway programs that identify and have traffic organizing capability with vehicles that have programs to take such signals to alert drivers or to directly guide the self-driving vehicle better. In such communication, "courtesy" could be effectively made a part of traffic organization and control for better traffic management. Acknowledge that transitions to accommodate change whether it is for drivers, new technologies, municipal traffic codes or other new ingredients in the mix, are part of an evolving process. Consider something that affects the FB where the FB can organize traffic on the feeder road coming into the first OM intersection but how does it organize a vehicle that enters the FB from a side street? Is there a driver's test for qualification? Is a self-driving vehicle to be qualified, and will the roadway be able to verify qualifications?

Those organizational innovations will come later outside of this one. However the FB architecture will help make those evolving systems of control and communication come about more easily if that roadway is more sensibly organized. With this recognition that there may be side issues to any lane signal or system of vehicle communication and control that is chosen the following basic model is offered as a way to express what a driver or vehicle would have to respond to on the FB itself.

In our example model the lane signals would still use the basic green, yellow and red format of signals but with refinements in signaling in order to better prompt driving behavior. In FIG. 5 the "X" position along the corridor would have signals for each individual lane and the lane traffic signals would have the basic purpose of maintaining the given speed of traffic flow for that segment of FB and the amount of compactness given the current travel demand. Green lights prompt the maintaining of the present desired speed, blinking green lights are for speeding up the movement to obtain closer spacing. Yellow lights are for reducing speed forming less need for vehicular closeness and blinking yellow lights are for caution and slowing of travel while yellow blinking lights accompanied with a blinking red light is for signaling preparation of a very slow speed or potential stopping and a lone red light is for stopping. The lone red signal light in the lane traffic signal system is essentially a fail-safe light as is the red light at the OM intersection.

As shown in the diagram there would likely be 2 or more of the X position lane traffic signals for the purpose of forming appropriately formed vehicular Packs and of maintaining the appropriate speed of a flowing Pack while also separating a Pack with a well-formed Gap so as to end up with that portion clear of vehicles that will allow the crossing roadway traffic movements to be performed at the OM intersections. This is so there are no interruptions in the flow of Packs through the FB corridor. Included in this signal method should be ways to make lane changes in the relatively close spacing even though there would be approximately 60 feet between vehicles with the closest spacing anticipated. And having made a lane change adjustment signaling should be made to enforce optimal spacing for vehicles.

The "Y" position lane traffic signals are a more intense use of forming Packs and the following Gaps for each individual lane so that there will be no vehicles out of place when the Pack enters the OM intersection. If there is a straggler, that vehicle (or those vehicles) will be directed to nearly stop in order to now be formed as a part of the following Pack after the Gap. This is so there will be no stopping of vehicles at the OM intersection which would create a disruption to the flow of the flowing Pack that will follow. Between the Y and Z traffic signal positions the stragglers are required to move very slowly in order to prepare to accelerate when given the blinking green light at the Z position in order to now be at the beginning of the Pack that has caught up from behind. This is all to maintain the well-formed Packs and Gaps so the FB works with flowing vehicles without interruptions. Drivers will need to learn to drive the FB or they will probably need to be excluded from it so the benefit is preserved for those who can drive it and not diminish the benefit of the high capacity and high level of service.

The "Z" position lane traffic signals have an even greater purpose of controlling the Packs and Gaps of the FB in that this is the last prompting that can be made before the On Module signal. At this Z position there are the same basic prompting as found at the Y position but these promptings have become more acute. In addition there are signals that prompt the appropriate use of the left turn queue lanes. Basically if the left turn queue is full it will display red signals indicating that the approaching vehicles will not be allowed to attempt to turn into the left turn queue pocket.

The Z position would also have photo or other enforcement for violations of not responding correctly to the signal prompting in any of the flow lanes or lanes for turning. If a straggler has made inadequate choices it would be smart for the traveler to simply move to the right to find a curb lane to get off the FB flowing lanes. By the time critical timing and spacing of vehicles are needed to require a FB to be made to provide adequate transportation in a corridor, the restrictions for the parking lanes during peak travel periods would likely only be used to allow for emergency vehicles, maybe some taxis and definitely for long bus pockets with additional deceleration and acceleration room to maneuver in. In off peak traffic periods general parking might take place when there is light traffic and the gaps between packs can be taken advantage of for the needed parking maneuvers.

The application of Flow Boulevards in existing developed urban areas to eliminate congestion can make sense; it is also within the context of the consolidating of suburban areas that development of FB corridors and of making networks can make a great deal of sense by putting growth in low density areas. It's likely that these urban areas would have differing street patterns over large areas and there would be a need to coordinate and make continuity for a high capacity corridor out to such irregular street patterns and differing land use densities. So there is a need to be able to connect different street patterns and geometries. An existing street pattern is also from which a FB emerges to start with.

In FIG. 6 is depicted the direct end to end connection of a single street FB to a couplet which is a very simple interchange. This example adaptation of a FB corridor to a differing existing street pattern can find use in both urban and suburban locations. As shown in FIG. 6, an OM intersection (c) begins the FB corridor (moving up the page). The traffic movement moving up the page on roadway "e" into the FB corridor will probably require a preparatory means of organizing the Packs and Gaps before the traffic flow enters the single street FB in order to synchronize with the FB flowing traffic structure. In contrast, the traffic flow coming out of the single street FB into roadway "f" of the couplet does not necessarily have to have Pack and Gap organization. A couplet can have progressively organized signalization on a one way street and the drivers can "self-organize" as to whether they want to go with the flow or not.

OM intersections are not needed in a couplet configuration in the sense that couplets are not timed with opposing traffic flows as in a single street right of way. This is because the couplet intersections (d) that allow cross traffic are separated and that traffic crossing each street of the couplet can be dealt with separately. However this is not always the case because if the couplet is to re-connect to another single street FB (further down the page for example), it is probable if not necessary, that coordinated intersections at crossing arterials would need to maintain the requirements of On Module intersection Pack and Gap organization on Roadway "f" in order to synchronize with re-entering a single street FB.

Couplets have less need for organization than does a single street FB. However they are not easily found in many existing street patterns, nor are they easily connected with. There may be parallel streets but they be of very different character, width, land use and continuity.

If there is no need to continue the high capacity corridor that the single lane FB provides then the tapering of travel demand simply may allow traffic to be dispersed into various portions of the existing street pattern with appropriate street and traffic provision.

It was shown in FIG. 6 how to connect a single street FB and a couplet end to end. What now will be shown is how to connect an FB corridor to a couplet corridor from the side forming a "T" configuration on FIG. 7 as one of the kinds of FB interchange. It is possible for this interchange to provide continuous flowing traffic among the three directions of travel (north, south and east) from one to another and provide the reversal of direction to go back on each of the FB (a) or on cpt-1, also with continuous flowing traffic.

In the case of FIG. 7 it will be assumed in this explanation that the single street FB (a), on the top or easterly part of the image, will be connected with the couplet which would have flowing traffic with progressive signaling running across the page. This hypothetical interchange actually has a basis of having been given preliminary engineering according to real travel demand conditions. The inclusion here in some detail will serve to illustrate adjustments to the FB roadways to conform to real life traffic conditions.

The couplet cpt-1 running north and south would be a major distributing and collecting facility for commuter trips to the surrounding area. The single street FB (a) connecting on the east side happens to have 42% less daily travel demand as compared to the couplet cpt-1 running north-south.

The movements vary north, south, east, and west between the AM morning distribution function to adjacent land use and the PM function of collecting commuters to return at the end of the work day. Based on this understanding the following AM period of explanation is made to demonstrate how signal timing can be affected according to the spacing of these intersections of the interchange while still providing continuous flowing vehicles through the interchange between the three directions of travel.

Intersection (c) is an OM intersection where the traffic flows of the single street FB (a) are timed where the Packs are to cross through the Gaps of the north bound couplet traffic (cpt-1) at intersection (c). Such intersections must be designed in order to provide the amount of respective times for signal light directing, number of lanes for cross traffic and for turning movements for each of the respective Boulevards and in regards to the travel demands on the intersection.

The basic "T" intersection of the FB (a) and the couplet (cpt-1) is a clue that the west flowing traffic of the single street FB will have a good amount of right turns at this first intersection. This will help balance the number of lanes needed in order to provide for the equal amount of time that is to be devoted to the Packs of both the north bound couplet cpt-1 traffic and the west bound single street FB traffic that will be going through that intersection. In other words, each Pack is losing a period of time, roughly 17% (from 72 seconds to 60 seconds in flow time given the example) but is gaining gap time of roughly 25% (from 48 to 60 seconds) in order to get both of their Packs through the intersection during a 2 minute signal cycle. Making sure there are an adequate number of lanes for each movement is part of the design. In this regard a sorting of traffic would occur in the mile segment of the FB (a) prior to arriving at (c); right turn traffic sorted from traffic continuing west would be put into appropriate lanes and a slight compaction of vehicles made in the westerly traffic flow through (c) to clear the Pack through intersection (c) in 60 seconds. And the north bound couplet (cpt-1) will have 4 lanes plus turning lanes for its greater travel demand to clear intersection (c) in 60 seconds as compared to the turning lanes and the 3lanes each way for the single street FB further east of intersection (c).

Following the westerly flowing Pack through (c) towards intersection d1, the flow there has a very high percentage of left turns due to the flows from the FB (a) which has demand to turn south on cpt-1. An even greater demand occurs from south bound couplet (cpt 1) at intersection d1 to continue south. These two demands must be out of phase so the Packs from each are going through the respective Gaps for each set of flowing vehicles. Remember the interchange in FIG. 7 has continuous flowing traffic. Another portion of the signal cycle is made for the signal at intersection d1 because of the need of making a gap in those flows to provide for the crossing of the traffic moving east from street (e2) at intersection d2. It is done at intersection d1 in the AM split of time with 50% of the signal time for the southerly traffic flows on couplet cpt-1, and with a split where the former flows of the westerly flows of the single street FB will turn south at d1 while less will continue west during the a-2 Pack flows. That reduced southerly traffic on a3 that has been made by traffic flowing west at intersection d1 provides a 10% "surplus of time" which can be given to the easterly flow of e2 traffic at intersection d2. To help in this regard from d1 to d2 some accelerating prompting to the a2 traffic turning southerly would help in gaining the ten second interval of time set for cross traffic going east at intersection d2. The southerly flow from d2 on cpt-1 is set to be at 40 mph (and possibly 45 mph) south of the interchange in that corridor so the acceleration is compatible with that acceleration. So the two minute signal cycle at intersection d2 will be comprised of 50% of southerly flow of cpt-1, 40% of the a3 flow that came from the a2 traffic turning south and 10% of the signal cycle at d2 from the roadway e2 that crosses to go east.

It should be mentioned that these traffic flows change at the respective intersections between the morning distribution period and the afternoon collection period which affect the interchange. Note that the PM signal cycle split at d1 was determined to be less than 40% for the cpt-1 and greater for a2 flows destined to turn south. After the 6% of effective cycle time of a2 traffic that flows west through d1 the d2 intersection has a signal cycle time proportion of 39% southerly flow for cpt-1, 49% cycle time for the a2 traffic that had turned south on to a3 and 12% for the roadway e2 signal cycle time serving traffic going east. The PM signal cycles will not be expressed in that the AM cycles will be sufficient to show how the interchange works.

It should be noted that the couplet cpt-2 is not a participant in continuous flowing traffic in this interchange. The intersection at d2 would have stop and go performance for e2 traffic thereby relieving that intersection for the need for having distance and timed signals to be conformed to by e2 traffic. It should be stated that another way to adjust flowing traffic to give the right percentage of signal time for a given intersection is by making the number of lanes serving the travel demand through that intersection to be balanced with the number of lanes and matching the proportion of signal time as in reducing that amount of signal time for a particular amount of traffic can be by making an additional lane or lanes. Couplet cpt-2 will be subject to designed controls, such as slowing into lanes for such commingling with flowing traffic, in order to have it included in the interchange.

Now again discussing the flowing traffic on the interchange, the traffic flows on the cpt-1 is a traffic flowing facility and must have signals not only timed to coordinate the flows between the single street FB (a) flows and the cpt-1 flows but the distance between the OM intersection (c) and intersection d1 will need to work regarding speed of traffic flow and the inherent length of Packs of traffic that are being served.

The cpt-1 couplet is ⅓rd of a mile (1760 feet) apart, and the cpt-2 is ⅙th of a mile apart (880 feet) and the vehicular flow of travel on a2 of about 30 mph to reach the d1 intersection takes 40 seconds. During the AM example, the south bound cpt 1 traffic flow from d1 having the signal set with an approximate 20 second lead time compared to the westerly flow from OM intersection (c) which takes 40 seconds of travel time to d1 lets it follow the cpt 1 southerly traffic flow, to then turn south at d1 to be at intersection d2 in a time of 60 seconds which is appropriate for the measuring of another 20 seconds of travel from d1 to d2 puts d2 60 seconds from OM intersection (c) to d2. If some of that traffic would take a left at d2 to return back through the OM intersection at (c), a return time at about 30 mph makes an equal time of 60 seconds and lets that formerly westerly flow of the FB (a) on the e3 roadways return through the intersection at (c) easterly on module giving continuous traffic flow through the entire interchange. It has also connected traffic to the north and to the south to cpt 1.

In regards to cpt-1 traffic flows, the southerly flow of cpt-1 will have the same distance to cover from d2 to (c) with the use of roadway (h) and by slowing up a bit in that it has a 20 second lead time, would have the right timing to go through that intersection in a northerly direction with its 50-50 split of the 2 minute signal cycle to have its original southerly direction of flow to now flow north on cpt-1 through intersection (c). That also relieves the OM intersection (c) from having to deal with excessive left hand turning movements.

If some of the southerly flow of cpt-1 turned left at d2 in order to go through the OM intersection at (c), the safest way to commingle that cpt-1 traffic with the formerly FB traffic that is destined to go back through intersection (c), is to slow down the cpt-1 traffic in the roadways of e3. The most advanced of the cpt-1 traffic would slow to about 19 mph while the ones that followed would be faster until they commingled with the pack of vehicles looking to return on the FB (a) through OM intersection (c).

The northerly flow of cpt-1 can go straight north or turn right through (c) to enter the FB flowing east. The flow that has turned left at OM intersection (c) has to be held to the later 40 seconds of its 60 second signal turn and by doing so by turning left, it can then commingle with the southerly flowing cpt 1 traffic by turning left at d1. And by continuing south through d2 the northerly cpt-1 traffic will have reversed direction through the interchange. The couplet member south of d2 will need to organize the mostly end to end traffic flow of the combined cpt-1 southerly flow and the following FB (a) traffic that has turned south at d1 and on through d2. This would be to establish a gap that will allow cross traffic to cross through at intersections south of d2. Adding to the gap that let the e2 traffic to move east through d2 would be an effective beginning along with being able to accelerate traffic movement to change the spacing for cross street signal timing, and to have an additional lane going south.

If the northerly flow of cpt 1 that turned left at (c) wants to continue through d1 westerly it will have to queue in a pocket or in slower traveling lanes on a2 until it joins the westerly flow from FB (a) on a2 to go through d1 west. As stated above, the cpt 2 couplet does not have complete continuous flow traffic to or from the interchange so such entering and exiting of the interchange are interrupted.

This completes the expression of the AM distribution period for the interchange. Yes, it is somewhat complex but the benefits can be extremely rewarding by improving a major congestion problem of traffic. It is also thought that as both roadways as well as vehicular improvements come about and that drivers become accustom to Flow Boulevard operations that such an intersection can be very much appreciated.

In FIG. 8 it shows what would be an interchange between the single street FB (a) that is to be connected with a crossing couplet (b-cpt). Couplets are a related kind of potentially flowing traffic facility so this connection is useful in the urban context to make a large network of high capacity flowing vehicular traffic and to connect the differing street configurations. The case shown is made for a closely spaced couplet which has crossing traffic at the two intersections (b-cpt) with the FB (a). There can be continuous flow of traffic between the single street FB (a) and a progressively signaled couplet by making the appropriate turns between them through the "half" OM intersections at c2, especially if those turns are fairly sweeping turns for left and right turns and if there are adjustments to speeds along with adequate deceleration and acceleration for vehicles in those respective lanes.

Since the typical OM intersection has been "split" to accommodate the couplet there are two intersections not widely separated (approximately one or two city blocks or 700 feet in the example). To avoid the condition of having two intersections closely spaced at grade that would affect the traffic flows in both directions of the FB (a) and make appropriate timing of those OM intersections and their long Packs not possible to be timed correctly, grade separations are required so the FB flowing lanes only incur one signalized intersection at grade in each direction that needs to be properly timed.

The grade separations at the two intersections b-cpt allow each direction of FB flowing traffic to be timed separately and to maintain the long length of Packs and the Gaps between them that they normally have. Traffic interchanges between the FB and couplet, even though they are in a way "half" OM intersections, simply occur at the respective at grade intersections at c2.

FIG. 8 is comprised of two Figures; FIG. 8A shows the full width of the couplet with its intersections c2 crossing the FB and in FIG. 8B is shown half of FIG. 8A so that more detailed relationships of roadway elements can be illustrated. FIG. 8B if inverted gives the image of the upper part of FIG. 8A in detail.

In FIG. 8A it can be seen that each of the opposing traffic flows of traffic on the FB (a) have ramps and a bridge (RB) over each one of the couplet traffic crossing intersections at c2. The FB retains the regular relationships of central median (m) with turning pockets (tp) and flow lanes (FL) for each opposing direction of traffic.

In FIG. 8B the intersection c2 is shown with a cut view through the ramps (RB) so that the typical turning movements of the intersection at grade can be seen. Flow lanes (FL) are numbered with the example as numbers 1 and 2. Additional lanes are indicated as a passing lane (pl) as number 3 and a curb lane (u) as number 4. If there were just one flow lane in each direction the lane numbers would be revised and if there were more than two Flow Lanes the numbers of such additional lanes would be revised accordingly.

As seen in FIG. 8A the intersections c2 are separated by approximately 700 feet (one or two blocks). This means that there would be slightly different timing for the intersection signal cycles at c2 which would require an adjustment in the opposing traffic flows on either side of the center of this "split OM" intersection for the FB. For example, going from the middle distance of the example, two intersections would put them 350 feet from a normal OM intersection timing. So in the direction of each of the traffic flows, both of the roadways leading into the intersections at grade (b-cpt) with the crossing traffic are 350 feet longer than normal. An adjustment in vehicular speed, or the average distance between vehicles would need to be made to adjust for the differences. This is so the other OM intersections are not disrupted in the arrival of vehicles at their intersections.

At 30 mph or 44 feet per second, that would be about 8 seconds of travel. Those 8 seconds of travel would mean that a little faster average speed than 30 mph for the segment of roadway leading into the interchange and a slower rate of travel for the segments of roadway leading away from the interchange for each direction of flow on the FB. If an adjustment is made by calculating required distances between vehicles to maintain capacity as well as timing; a longer space between vehicles going into the interchange and a closer spacing between vehicles going away from the interchange would be required.

By the introduction of these different interchange designs in FIGS. 6, 7 and 8, they may provide the adaptation of single streets and couplets to make various corridors viable candidates for higher capacity and higher level of service improvement of continuous flowing vehicular travel over a broad urban area. The Detailed Descriptions of these eight figures illustrate basic relationships of roadways and traffic operation where the point of each shows at least one working example. In the real world there are many variations of these basic relationships which can work as well. I think they can be of great benefit.

End Detailed Description

The invention claimed is:

1. A Flow Boulevard roadway system to provide and control continuously flowing vehicular traffic comprising:

a. a flow boulevard for two-way continuous flowing packs of vehicles divided by a median with a crossing street at a plurality of on-module intersections, one or more lanes for continuous flowing packs of vehicles in each direction on said flow boulevard having evenly spaced distances and the same speed of vehicles from one on-module to another on-module intersection resulting in continuous flowing packs of vehicles in both directions through on-module intersections for the length of the boulevard;

b. at least one interchange operative to connect continuous flowing packs of vehicles from the flow boulevard to a couplet of one-way streets beyond the flow boulevard in order to enable continuous flowing traffic to occur between the flow boulevard and the couplet;

c. an on-module intersection signal at each on-module intersection in each direction comprising a successive green signal and red signal, the duration of each green and red signal together comprising a flow boulevard traffic signal cycle, wherein the duration of the green signal defines a pack period allowing each continuous flowing pack of vehicles to traverse the on-module intersection, and the duration of the red signal defines a gap period occurring between each continuous flowing pack of vehicles allowing traffic to cross the flow boulevard at each on-module intersection as well as allowing vehicles to make turning movements between the flow boulevard and the crossing street;

d. a system of lane signals comprising:

i. a first type of lane signal at each flow boulevard lane prompting vehicular speed and spacing of vehicles between on-module intersections, on segments of couplets with continuous flowing traffic connected to the flow boulevard, and within interchange;

ii. a second type of lane signal as lines of lane signals crossing the flow boulevard to provide the minor pack gathering area at each on-module intersection in each flow boulevard direction to receive any incoming gap period vehicles which have entered the flow boulevard from adjacent abutting side streets and driveways to form a minor pack, wherein the minor pack merges with the continuous flowing pack of vehicles through the on-module intersection;

iii. a third type of lane signals crossing the flow boulevard at each interchange and configured to optimize traffic flow in the interchange;

e. between on-module intersections, a plurality of abutting side streets and driveways which do not directly cross the flow boulevard, wherein access between the flow boulevard and said abutting side streets and driveways occurs during the gap period;

f. sidewalks occurring along the boulevard;

wherein the operation of the system of lane signals and on-module intersection signals together result in continuous flowing traffic from on-module to on-module intersection; and wherein a pedestrian may cross the flow boulevard in accordance with signalized traffic movements throughout the flow boulevard at any of the on-module intersections, abutting side streets and driveways, within interchanges, and across any median signalized vehicle crossings of flow boulevard lanes along with said pedestrian crossings in conjunction with signalized traffic movements throughout the flow boulevard.

2. The flow boulevard of claim 1, wherein the median is configured to control any crossing access to and from the abutting side streets and driveways with the flow boulevard between on-module intersections and operative to avoid obstructing continuous flowing packs of vehicles along the flow boulevard by limiting crossing movements to gap periods.

3. The flow boulevard of claim 2, wherein a portion of the median is configured to define a pocket for receiving a vehicle turning left from an abutting side street or driveway on to the flow boulevard, and wherein a side street signal is provided and timed to permit such vehicle to turn left on to the flow boulevard during a gap period.

4. The flow boulevard of claim 2, wherein a portion of the median is configured to define a pocket for separating a left turning vehicle from the continuous flowing pack of vehicles on the flow boulevard, and wherein a median signal is provided and timed to permit such vehicle to turn left off of the flow boulevard and on to an abutting side street or driveway during a gap period.

5. The flow boulevard of claim 1, further comprising, a. at a first distance set back from each on-module intersection in both directions, a line of lane signals crossing the flow boulevard to define an acceleration zone; and b. at a second, further distance set back from each on-module intersection in both directions, a line of lane signals wherein the minor pack of vehicles is gathered;

wherein the minor pack joins a continuous flowing pack of vehicles at the beginning of the pack period at on-module intersections with vehicular movement into said acceleration zone; and wherein the minor pack merges with the continuous flowing pack of vehicles as such gathered minor pack moves through the acceleration zone and on-module intersection and each type of lane signals turns green.

6. The flow boulevard of claim 1, wherein the at least one interchange is a Single Street FB Connected to a Couplet Interchange that connects end to end between respective directions of flow boulevard lanes and any lanes comprising the couplet.

7. The flow boulevard of claim 6, wherein the Single Street FB Connected to a Couplet Interchange further comprises couplet lane signals in combination with progressive signalized traffic signals along the couplet operative to synchronize speed and spacing of any continuous flowing packs of vehicles traveling on the couplet with any continuous flowing pack of vehicles traveling on the flow boulevard, enabling continuously flowing traffic to occur between the flow boulevard and the couplet.

8. The flow boulevard of claim 1, wherein the at least one interchange is a Couplet FB Interchange with a Single Street FB to the side of a widely spaced couplet wherein a counter clockwise roadway connects any roads between a near one-way street of the widely spaced couplet and a far one-way street of the widely spaced couplet to the flow boulevard.

9. The flow boulevard of claim 8, wherein the Couplet FB Interchange with a Single Street FB occurs at an end of the flow boulevard connected to the side of a widely spaced couplet of one-way streets, wherein the near one-way traffic street of the couplet crosses through the end flow boulevard on-module intersection at an intersection C; and wherein said intersection C is the first of three intersections connecting three one-way segments of roadway with continuous flowing packs of vehicles that comprises the counter clockwise roadway of one-way streets connecting the widely separated couplet of the two one-way streets of the couplet to the end of the flow boulevard at intersection C; and wherein the flow boulevard, couplet streets, and counter clockwise roadway between them have continuous flowing traffic in which all turning movements connecting any flow boulevard and couplet traffic to each other have continuous flowing traffic through intersections and roadways making all four directions of traffic exchange with continuous flowing traffic.

10. The flow boulevard of claim 1, wherein the at least one interchange is a Couplet Interchange with Grade Separations and Widened On-module Intersections used at an end of the flow boulevard or within the flow boulevard at an on-module intersection; and wherein each direction of the flow boulevard comprises continuous vehicular flow connections for left or right turns to connect the flow boulevard to each direction of any crossing one-way streets of the couplet; and wherein in each direction of the flow boulevard, a grade separation occurs between a first encountered one-way street of the couplet and flow boulevard allowing continuous flowing traffic to pass one another at the first encountered one-way street; and wherein a second encountered one-way street of the couplet is a half on-module intersection allowing continuous flowing traffic to cross one another during the respective pack period and gap period at the half on-module intersection; and wherein each crossing one-way street of the couplet has continuous flowing traffic for left and right turn connections onto the flow boulevard or continued travel on the one-way street through the half on-module intersection thereby making each of the four directions of travel able to exchange continuous flowing traffic.

* * * * *